US008354899B2

(12) United States Patent
Keimel et al.

(10) Patent No.: US 8,354,899 B2
(45) Date of Patent: Jan. 15, 2013

(54) SWITCH STRUCTURE AND METHOD

(75) Inventors: Christopher Fred Keimel, Schenectady, NY (US); Marco Francesco Aimi, Niskayuna, NY (US); Shubhra Bansal, Niskayuna, NY (US); Reed Roeder Corderman, Niskayuna, NY (US); Kuna Venkat Satya Rama Kishore, Bangalore (IN); Eddula Sudhakar Reddy, Bangalore (IN); Atanu Saha, Bangalore (IN); Kanakasabapathi Subramanian, Clifton Park, NY (US); Parag Thakre, Bangalore (IN); Alex David Corwin, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 335 days.

(21) Appl. No.: 12/565,127

(22) Filed: Sep. 23, 2009

(65) Prior Publication Data

US 2011/0067983 A1 Mar. 24, 2011

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,258,591 | A * | 11/1993 | Buck | 200/181 |
| 6,153,839 | A * | 11/2000 | Zavracky et al. | 200/181 |
| 6,624,003 | B1 * | 9/2003 | Rice | 438/106 |
| 6,699,379 | B1 | 3/2004 | Ke et al. | |
| 6,809,412 | B1 * | 10/2004 | Tourino et al. | 257/678 |
| 7,126,220 | B2 | 10/2006 | Lahiri et al. | |
| 7,247,035 | B2 | 7/2007 | Mok et al. | |
| 7,393,594 | B2 | 7/2008 | Yamasaki et al. | |
| 7,663,456 | B2 * | 2/2010 | Subramanian et al. | 335/78 |
| 7,812,703 | B2 | 10/2010 | Carlson et al. | |
| 2003/0116417 | A1 | 6/2003 | DeReus | |
| 2004/0154925 | A1 | 8/2004 | Podlaha et al. | |
| 2005/0007219 | A1 * | 1/2005 | Ma et al. | 335/78 |
| 2007/0215448 | A1 | 9/2007 | Paranjpye et al. | |
| 2008/0087530 | A1 * | 4/2008 | Paranjpye et al. | 200/181 |
| 2008/0237024 | A1 * | 10/2008 | Millet | 200/600 |
| 2009/0127082 | A1 | 5/2009 | Zhang et al. | |

OTHER PUBLICATIONS

European Search Report dated Mar. 9, 2011 and Written Opinion.
Haj-Taleb et al., "Thermal Stability of Electrodeposited LIGA Ni—W Alloys for High Temperature MEMS Applications", Midcrosyst Technol, vol. 14, pp. 1531-1536, May 2008.
Haseeb et al., "Friction and Wear Characteristics of Electrodeposited Nanocrystalline Nickel-Tungsten Alloy Films", ScienceDirect, Wear, vol. 264, pp. 106-112, Mar. 2007.

(Continued)

*Primary Examiner* — Bernard Rojas
(74) *Attorney, Agent, or Firm* — Jason K. Klindtworth

(57) ABSTRACT

Provided is a device, such as a switch structure, that includes a contact and a conductive element that is configured to be deformable between a first position in which the conductive element is separated from the contact and a second position in which the conductive element contacts the contact. The conductive element can be formed substantially of metallic material configured to inhibit time-dependent deformation. For example, the metallic material may be configured to exhibit a maximum steady-state plastic strain rate of less than $10^{-12}\,s^{-1}$ when subject to a stress of at least about 25 percent of a yield strength of the metallic material and a temperature less than or equal to about half of a melting temperature of the metallic material. The contact and the conductive element may be part of a microelectromechanical device or a nanoelectromechanical device. Associated methods are also provided.

40 Claims, 3 Drawing Sheets

OTHER PUBLICATIONS

Slavcheva et al., "Electrodeposition and Properties of NiW Films for MEMS Application", ScienceDirect, Electrochimica Acta, vol. 50, 5573-5580, Jun. 2005.

Namburi, Electrodeposition of NiW Alloys Into Deep Recesses, A Theseis Submitted to the Graduate Faculty of the Louisiana State University and Agricultural and Mechanical College in partial fulfillment of the requirements for the degree of Master of Science in Chemical Engineering in the Department of Chemical Engineering, 50 pages, Dec. 2001.

* cited by examiner

SWITCH STRUCTURE AND METHOD

BACKGROUND

Embodiments of the invention relate generally to devices for switching current, and more particularly to microelectromechanical switch structures.

A circuit breaker is an electrical device designed to protect electrical equipment from damage caused by faults in the circuit. Traditionally, many conventional circuit breakers include bulky (macro-)electromechanical switches. Unfortunately, these conventional circuit breakers are large in size may necessitate use of a large force to activate the switching mechanism. Additionally, the switches of these circuit breakers generally operate at relatively slow speeds. Furthermore, these circuit breakers can be complex to build and thus expensive to fabricate. In addition, when contacts of the switching mechanism in conventional circuit breakers are physically separated, an arc can sometimes form therebetween, which arc allows current to continue to flow through the switch until the current in the circuit ceases. Moreover, energy associated with the arc may seriously damage the contacts and/or present a burn hazard to personnel.

As an alternative to slow electromechanical switches, relatively fast solid-state switches have been employed in high speed switching applications. These solid-state switches switch between a conducting state and a non-conducting state through controlled application of a voltage or bias. However, since solid-state switches do not create a physical gap between contacts when they are switched into a non-conducting state, they experience leakage current when nominally non-conducting. Furthermore, solid-state switches operating in a conducting state experience a voltage drop due to internal resistances. Both the voltage drop and leakage current contribute to power dissipation and the generation of excess heat under normal operating circumstances, which may be detrimental to switch performance and life. Moreover, due at least in part to the inherent leakage current associated with solid-state switches, their use in circuit breaker applications is not possible.

Micro-electromechanical system (MEMS) based switching devices may provide a useful alternative to the macro-electromechanical switches and solid-state switches described above for certain current switching applications. MEMS-based switches tend to have a low resistance when set to conduct current, and low (or no) leakage when set to interrupt the flow of current therethrough. Further, MEMS-based switches are expected to exhibit faster response times than macro-electromechanical switches.

BRIEF DESCRIPTION

In one aspect, a device, such as a switch structure, is provided. The device includes a contact and a conductive element that is configured to be deformable between a first position in which the conductive element is separated from the contact and a second position in which the conductive element contacts, and possibly establishes electrical communication with, the contact. For example, the conductive element may include a cantilever, a fixed-fixed beam, a torsional element, and/or a diaphragm. The device may also include an electrode configured to be charged so as to apply an electrostatic force configured to urge the conductive element toward the second position.

The contact and the conductive element (and the electrode) may be part of a microelectromechanical device or a nano-electromechanical device. For example, the conductive element has a surface area-to-volume ratio that is greater than or equal to about $10^3$ $m^{-1}$. Each of the contact and the conductive element may be disposed on a substrate, which substrate may include a metal oxide semiconductor field effect transistor.

The conductive element can be configured to store therein sufficient energy during deformation to cause the conductive element to assume the first position in the absence of external forces. Further, the conductive element can be configured to be separated from the contact by a separation distance that varies by less than about 40 percent when the conductive element substantially occupies the first position and to be urged toward the second position by an applied force and to substantially return to the first position in the absence of an applied force. In some embodiments, the conductive element may be configured to experience a stress of at least about 100 MPa over a cumulative time of at least about 10,000 seconds when occupying the second position.

The conductive element can be formed substantially of metallic material configured to inhibit time-dependent deformation, say, at temperatures greater than about 40° C. For example, the metallic material may be configured to exhibit a maximum steady-state plastic strain rate of less than $10^{-12}$ $s^{-1}$ when subject to a stress of at least about 25 percent of a yield strength of the metallic material and a temperature less than or equal to about half of a melting temperature of the metallic material. In some embodiments, the metallic material may include an alloy of at least nickel and tungsten, for example, an alloy including at least 65 atomic percent nickel and at least 1 atomic percent tungsten. The alloy of nickel and tungsten may have an average grain size of less than or equal to about 1 μm. In other embodiments, the metallic material may include amorphous metal. In still other embodiments, the metallic material may have a melting temperature of at least 700° C. In yet other embodiments, the metallic material may be non-magnetic.

The device may further include a circuit having a first side and a second side at different electric potentials. The contact and conductive element can be respectively connected to one and the other of the first and second sides of the circuit, such that deformation of the conductive element between the first and second positions acts to respectively pass and interrupt a current therethrough, say, at ambient temperatures under 30 percent of a melting temperature of the metallic material. The first side can include a power source configured to supply a current with a magnitude of at least 1 mA and an oscillation frequency less than or equal to about 1 kHz. In some embodiments, the device may include a second conductive element formed substantially of metallic material configured to inhibit time-dependent deformation. The second conductive element can be configured to be deformable between a first position in which the conductive element is separated from a second contact and a second position in which the conductive element contacts the second contact. The conductive element and the second conductive element can be arrayed in series and in parallel as part of a circuit disposed on a substrate.

In another aspect, a method is provided that includes providing a substrate and forming a contact on the substrate. A conductive element can be formed on the substrate, the conductive element being formed substantially of an alloy of at least nickel and tungsten (for example, via electroplating) and being configured to be deformable between a first position in which the conductive element is separated from the contact and a second position in which the conductive element contacts the contact. An electrode can also be formed on the substrate, the electrode being configured to establish an electrostatic force sufficient to urge the conductive element into the second position. The conductive element can then be exposed to a temperature of at least 300° C. Additionally, the contact and conductive element can be enclosed between the substrate and a protective cap.

The contact and conductive element can be respectively connected to opposing sides of a circuit, the opposing sides being at different electric potentials when the opposing sides are disconnected. The conductive element can be selectively deformed between the first and second positions so as to respectively pass and interrupt a current therethrough, for example, a current with an amplitude of at least 1 mA and an oscillation frequency of less than or equal to about 1 kHz. In some embodiments, the conductive element may be selectively deformed at a use temperature of at least 40° C. and less than 250° C. so as to respectively pass and interrupt a current therethrough. In some embodiments, the conductive element can be exposed to process temperature that is greater than the use temperature prior to selectively deforming the conductive element between the first and second positions so as to respectively pass and interrupt a current therethrough.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
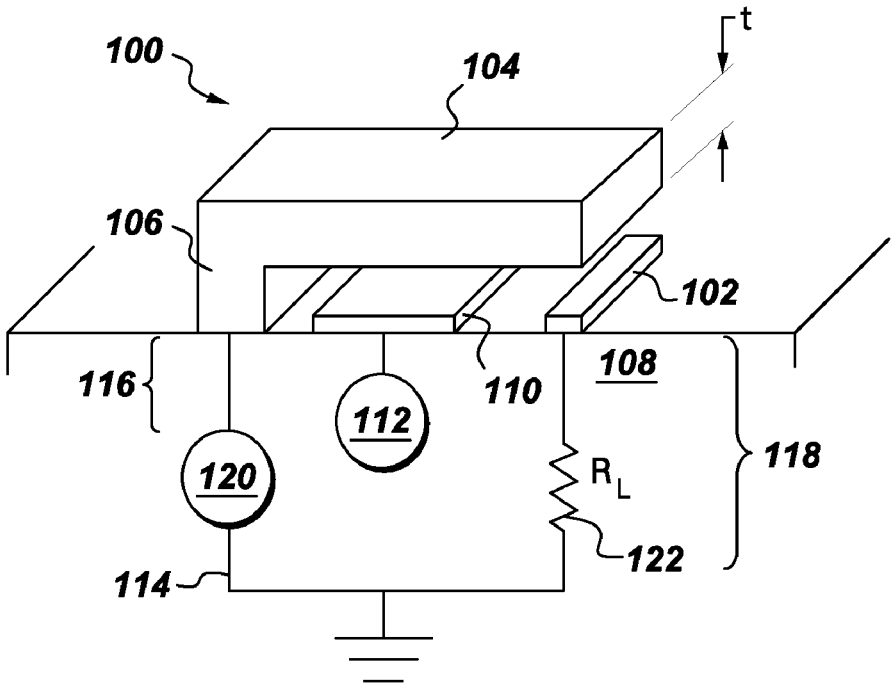
FIG. 1 is a schematic perspective view of a switch structure configured in accordance with an example embodiment.

Example embodiments of the present invention are described below in detail with reference to the accompanying drawings, where the same reference numerals denote the same parts throughout the drawings. Some of these embodiments may address some of the above and other needs.

Figure 2:
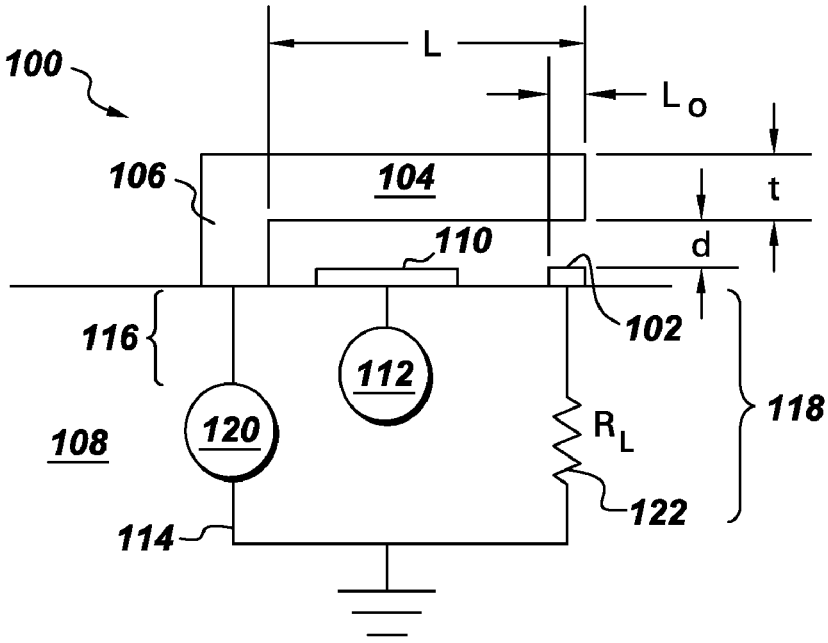
FIG. 2 is a schematic side view of the switch structure of FIG. 1.
Figure 3:
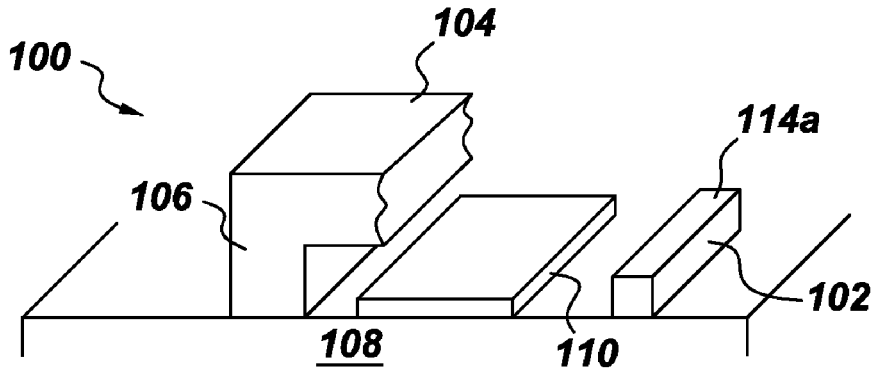
FIG. 3 is a schematic fragmentary perspective view of the switch structure of FIG. 1.
Figure 4:
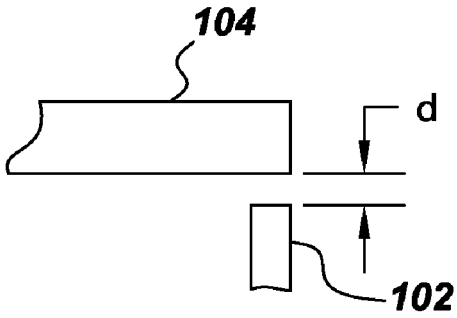
FIG. 4 is a schematic side view of the switch structure of FIG. 1 in an open position.
Figure 5:
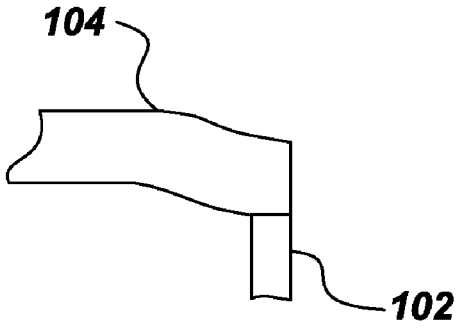
FIG. 5 is a schematic side view of the switch structure of FIG. 1 in a closed position.

Referring to FIGS. 1-3, therein are shown several schematic views of a switch structure 100 configured in accordance with an example embodiment. The switch structure 100 can include a contact 102, which may be, for example, a pad formed, at least partially, of a conductive material (e.g., metal). The switch structure 100 can also include a conductive element, such as a cantilevered beam 104, formed at least partially of conductive material (e.g., metal). In some embodiments, the conductive element may also include other features, such as, for example, a protective (and possibly non-conductive) coating on the beam 104 and/or a contact pad, say, disposed over a portion of the beam intended to contact the contact 102 (discussed further below). The beam 104 can be supported by an anchor 106, which may be integrated with the beam and may serve to connect the beam to an underlying support structure, such as a substrate 108. The contact 102 may also be supported by the substrate 108.

Disposing the contact 102 and beam 104 on a substrate 108 may facilitate the production of the switch structure 100 through conventional microfabrication techniques (e.g., electroplating, vapor deposition, photolithography, wet and/or dry etching, etc.). Along these lines, the switch structure 100 may constitute a portion of a microelectromechanical or nanoelectromechanical device or a microelectromechanical system (MEMS). For example, the contact 102 and beam 104 may have dimensions on the order of ones or tens of micrometers and/or nanometers. In one embodiment, the beam 104 may have a surface area-to-volume ratio that is greater than or equal to $10^8$ $m^{-1}$, while in another embodiment the ratio may be closer to $10^3$ $m^{-1}$. Details regarding possible methods for fabricating the switch structure 100 are discussed further below.

The substrate 108 may also include or support conventional semiconductor devices and/or components, such as, for example, metal-oxide-semiconductor field effect transistors (MOSFETs) and patterned conductive layers (not shown) that serve to provide electrical connections thereto and therebetween. Such patterned conductive layers may also provide electrical connections to the contact 102 and beam 104 (the connection to the latter being, for example, through the anchor 106), which connections are shown schematically in FIGS. 1 and 2 and described below. The semiconductor devices and conductive layers, like the features of the switch structure 100, can be fabricated using conventional microfabrication techniques. In one embodiment, the substrate 108 may be a semiconductor wafer that has been processed so as to include one or more MOSFETs, with the switch structure 100 and other circuitry formed on a surface of the wafer. The switch structure 100 may be disposed over one of the MOSFETs (e.g., a line normal to the surface of the wafer would intersect both the MOSFET and the switch structure) and may be operable along with the MOSFET (discussed further below).

Referring to FIGS. 1-5, the beam 104 can be configured to be selectively moveable between a first, non-contacting or "open" position (e.g., FIG. 4), in which the beam is separated from the contact 102 by a separation distance d, and a second, contacting or "closed" position (e.g., FIG. 5), in which the beam comes into contact and establishes electrical communication with the contact. For example, the beam 104 can be configured to undergo deformation when moving between the contacting and non-contacting positions, such that the beam is naturally disposed (i.e., in the absence of externally applied forces) in the non-contacting position and may be deformed so as to occupy the contacting position while storing mechanical energy therein. In other embodiments, the undeformed configuration of the beam 104 may be the contacting position.

The switch structure 100 may also include an electrode 110. When the electrode 110 is appropriately charged, such that a potential difference exists between the electrode and the beam 104, an electrostatic force will act to pull the beam towards the electrode (and also toward the contact 102). By appropriately choosing the voltage to be applied to the electrode 110, the beam 104 can be deformed by the resulting electrostatic force sufficiently to move the beam from the non-contacting (i.e., open or non-conducting) position to the contacting (i.e., closed or conducting) position. Therefore, the electrode 110 may act as a "gate" with respect to the switch structure 100, with voltages (referred to as "gate voltages") applied to the electrode serving to control the opening/closing of the switch structure. The electrode 110 may be in communication with a gate voltage source 112, which gate voltage source may apply a selective gate voltage $V_G$ to the electrode.

The contact 102 and beam 104 may act as part of a circuit 114. For example, the circuit 114 can have a first side 116 and a second side 118 that, when disconnected from one another, are at different electric potentials relative to one another (as where only one of the sides is connected to a power source 120). The contact 102 and beam 104 can be respectively connected to either of the sides 116, 118 of the circuit 114, such that deformation of the beam between the first and second positions acts to respectively pass and interrupt a current therethrough. The beam 104 may be repeatedly moved into and out of contact with the contact 102 at a frequency (either uniform or non-uniform) that is determined by the application within which the switch structure 100 is utilized. When the contact 102 and the beam 104 are separated from one another, a potential difference, and voltage difference, would exist between the contact and beam, and this voltage difference is referred to as the "stand-off voltage."

In one embodiment, the beam 104 may be in communication (e.g., via the anchor 106) with the power source 120, and the contact 102 may be in communication with an electrical load 122 presenting, say, a load resistance $R_L$. The power source 120 may be operated at different times as a voltage source and a current source. As such, the beam 104 may act as an electrical switch, allowing a load current (say, with an amplitude greater than or equal to about 1 mA and an oscillation frequency of less than or equal to about 1 kHz) to flow from the power source 120 through the beam and the contact 102 and to the electrical load 122 when the beam is in the contacting position, and otherwise disrupting the electrical path and preventing the flow of current from the power source to the load when the beam is in the non-contacting position. The above-indicated current and switching frequency might be utilized in relatively higher power distribution applications. In other embodiments, such as in applications where the switch structure 100 will be utilized in a signaling context (often operating at relatively lower powers), the power source 120 may provide a current having a magnitude of 100 mA or less (and down to the 1 μA range) with a frequency of oscillation greater than 1 kHz.

The above-described switch structure 100 could be utilized as part of a circuit including other switch structures, whether similar or dissimilar in design, in order to increase the current and voltage capacity of the overall circuit. For example, the switch structures could be arrayed both in series and in parallel in order to facilitate an even distribution of stand-off voltage when the switch structures are open and an even distribution of current when the switch structures are closed.

During operation of the switch structure 100, the beam 104 may be subjected to externally applied forces, such as the electrostatic force established by the electrode 110 discussed above, that cause the beam to deform between the first and second positions (i.e., into and out of contact with the contact 102). These forces may be applied, and the switch structure 100 may operate, at ambient temperatures (use temperatures) from room temperature up to or above 40° C., but often less than 50 percent or even 30 percent of the melting temperature of the material(s) from which the beam is substantially formed. Further, for applications in which the switch structure 100 is expected to possess a useful lifetime on the order of years (e.g., relatively higher power distribution applications), the beam 104 may remain in contact with the contact 102 for a cumulative time of at least $10^4$ seconds, and in some cases for more than $10^6$ seconds or even $10^8$ seconds. Still further, when deformed so as to contact the contact 102, the beam 104 may experience relatively high stresses, the magnitude of the stresses depending on the geometry of the switch structure 100 and the material from which the beam is substantially formed.

As one example of the above, the switch structure 100 can include a cantilevered beam 104 of nickel (Ni)-12 atomic percent tungsten (W) with a length L of about 100 μm, an aspect ratio (length L to thickness t) of about 25 to 1, and a separation distance d from the contact 102 of about 5 μm, where the contact is located opposite the free end of the beam and overlaps the beam by a distance $L_o$. For such geometry, a stress of more than 100 MPa, and as much as 600 MPa or more, may be present in substantial portions of the beam 104 and/or anchor 106 when the beam is deformed so as to contact the contact 102. As mentioned earlier, in some applications, the beam 104 and/or anchor 106 may be required to sustain this stress for a time that may be as long or longer than $10^4$ seconds under use conditions, without failure. These stresses are expected to be separate from the highly localized, and often transient, stresses that may be present around stress concentration regions, such as around geometrical irregularities and surface asperities.

For proper operation of a switch structure (such as the switch structure 100) including a cantilevered beam (or other deformable contacting structure) and associated contact, it is often intended that the beam assume either the contacting position or the non-contacting position as specified by the presence or absence of an external force urging the beam into contact with the contact (e.g., the presence or absence of the gate voltage associated with the electrode 110 and the corresponding electrostatic force). However, a variety of investigators have observed that switch structures including a metallic, micrometer-scale cantilevered beam (or other deformable contacting structure) tend to malfunction, such that the behavior of the switch structure is not as intended. These malfunctions are generally attributed to surface adhesion-related issues. Specifically, in light of the large surface area-to-volume ratio present in a micrometer-scale beam (or other deformable contacting structure), the energy reduction associated with the elimination of free surface where the beam contacts the associated contact pad may be non-trivial or even higher relative to the mechanical energy stored in the beam during deformation. As such, theory has it, the cantilevered beam and associated contact remain adhered following the removal of the external force otherwise urging the two into contact, as the internal strain energy of the beam is insufficient to induce separation of the beam from the contact.

In contrast to the prevailing theories, Applicants have observed that failure of switch structures including metallic, small-scale cantilevered beams is often due not to adhesion of the beam and an associated contact, but mainly to a change in the undeformed configuration of the beam. That is, as an external force is applied to urge the beam into contact with the associated contact, the beam undergoes time-dependent plastic deformation, also referred to as "creep." In conjunction with this time-dependent plastic deformation, the beam has in some cases been observed to experience fatigue in response to repeated loadings. The fatigue would appear to be a function of the time-dependent plastic deformation, occurring to the greatest extent at stress concentration locations along the beam and anchor.

As the beam undergoes time-dependent plastic deformation, the undeformed configuration of the beam (i.e., the shape the beam assumes in the absence of an external load) moves from that with the beam disposed in the non-contacting position towards a configuration in which the beam is disposed in the contacting position. Similarly, the mechanical strain energy initially associated with the beam when in the contacting position is reduced, in some cases to nearly zero. Ultimately, the switch structure may fail due to adhesion between the beam and the associated contact, but this failure mechanism may be secondary, and due, to the reduction in the mechanical strain energy associated with the beam in the contacting position. The time-dependent plastic deformation of the beams associated with switch structures is surprising, in that these devices are often operating at ambient temperatures under 50 percent or even 30 percent of the melting temperature of the metallic material from which the beam is formed.

In view of Applicants' discovery, the beam 104 may be formed substantially of metallic material that is configured to inhibit time-dependent deformation, such as at temperatures from room temperature up to or above 40° C. and less than 50 percent of the melting temperature of the material from which the beam is substantially formed (or, if the beam is formed of multiple discrete metallic materials, the minimum melting temperature associated with one of the metals constituting a substantial part of the beam). Further, the metallic material can have a melting temperature of at least 700° C. A material that is configured to inhibit time-dependent deformation (a "creep-resistant material") is, for example, a material that exhibits a relatively small steady-state plastic strain rate when subjected to a continuing load/stress. It is noted that what constitutes a "small" plastic strain rate may depend on the context within which creep may be occurring. For the purposes of the present application, a creep-resistant material is generally a material for which the steady-state plastic strain rate is less than or equal to about $10^{-12}$ $s^{-1}$ for stresses up to about 25 percent of the yield strength of the material and for temperatures of less than half of the melting temperature of the creeping material. Further, the beam 104 can be considered to be "formed substantially" of metallic material that is configured to inhibit time-dependent deformation when the mechanical behavior of the beam is generally or significantly determined by the mechanical behavior of constituent metallic material.

A variety of chemical compounds can act as creep-resistant metallic materials when being utilized at temperatures less than about half to one third the melting temperature of the material, and these materials can be synthesized in a variety of ways so as to produce a variety of operable microstructures. For example, creep-resistance can result from an increase in melting temperature, which, for a given operational condition, will slow diffusion-based recovery processes. Alternatively, creep-resistance can be a consequence of micro structural manipulation. For example, crystalline material can be formed with small grain size, thereby limiting creep related to dislocation motion. Alternatively, additives can be added to a material, which additives either may be dissolved in the crystal lattice, thereby leading to solid solution strengthening, and/or may form another phase, for example, by precipitating out at grain boundaries and/or within the crystal lattice. The additives can act as discrete particles that serve to block dislocation motion, inhibit diffusion, and/or act as traps for voids in the crystal lattice. In some embodiments, oxides and/or carbides may be utilized as the additives. Generally, examples of creep-resistant materials may include superalloys, including Ni-based and/or cobalt (Co)-based superalloys, Ni—W alloys, Ni-manganese (Mn) alloys, gold containing small amounts of Ni and/or Co ("hard gold"), W, intermetallics, materials with fine grains, materials subject to solid solution and/or second phase strengthening, and materials having a crystal structure in which plastic deformation is inhibited, such as hexagonal structures or materials with low stacking fault energies.

By forming the beam 104 substantially from creep-resistant material having a relatively high melting temperature, it has been observed by Applicants that significant creep during use may be avoided, such that the separation distance d between the beam and the contact 102 can be maintained fairly constant, say, within 20-40 percent of its initial value, for a time in use of up to 1 year and in some cases upwards of 20 years (a requirement for some applications). In other words, for each instance in which the beam 104 is urged from the non-contacting position (in which the beam is separated from the contact 102 by a distance d) and toward the contacting position by an applied force and then the applied force is removed, the beam will substantially return to the non-contacting position such that the beam is separated from the contact by the distance d, where the value of d varies by less than 40 percent, and in some cases less than 20 percent.

The metallic, creep-resistant material may include an alloy of at least Ni and W. Applicants have found that alloys containing at least 65 atomic percent Ni and at least 1 atomic percent W tend to exhibit enhanced creep resistance of the alloy. One specific example of an alloy that has been observed by Applicants to exhibit such a resistance to creep is Ni-4 atomic percent W. However, as indicated above, alloys including substantially Ni and as little as about 1 atomic percent W are expected to show improved creep resistance, and the extent to which creep is inhibited will scale with W content.

The alloy of Ni and W may (e.g., when electroplated under direct current conditions) have an average grain size of less than or equal to about 1 μm, and in some cases down to a size on the order of 10 nm. For example, an alloy of 96 atomic percent Ni and 4 atomic percent W may be electroplated, say, under direct current conditions to produce a film of Ni—W material having an average grain size of about 10-100 nm. The Ni—W film may be subsequently exposed to elevated temperature, for example, by annealing at 300-450° C. for 30 minutes, in order to further enhance the material's resistance to creep. Generally, Applicants have found that annealing Ni—W films at relatively low temperatures, but which temperatures are higher than those that will be experienced during use conditions (which, for higher power distribution applications, tends to be less than or equal to about 250° C.), acts to limit the extent of time-dependent deformation experienced by structures formed of the annealed Ni—W film.

As indicated above, the process temperatures associated with the production of the above described switch structure 100 formed substantially of metallic material configured to inhibit time-dependent deformation are moderate, usually less than 450° C. This is in contrast to the temperatures required to form a conductor from silicon, which, when employing a conventional doping procedure, are usually greater than 900° C. The lower processing temperatures associated with the switch structure 100 may facilitate the integration of the switch structure with temperature-sensitive components, such as, for example, MOSFETs.

The metallic, creep-resistant material may include amorphous metal. Examples of amorphous metals include alloys of at least Ni, W, and iron (Fe), where the alloy includes greater than or equal to about 80 atomic percent Ni, between about 1 and 20 atomic percent W, and less than or equal to about 1 atomic percent Fe. These materials are characterized by their lack of long-range atomic order, and are generally considered to be relatively resistant to plastic deformation. Many amorphous alloys are formed by mixing many different elements, often with a variety of atomic sizes, such that the constituent atoms cannot coordinate themselves into an equilibrium crystalline state during cooling from a liquid state.

Other examples of amorphous metals include, but are not limited to, 55 atomic percent palladium (Pd), 22.5 atomic percent lead, and 22.5 atomic percent antimony; 41.2 atomic percent zirconium (Zr), 13.8 atomic percent titanium (Ti), 12.5 atomic percent copper (Cu), 10 atomic percent Ni, and 22.5 atomic percent beryllium; and amorphous alloys based on Zr, Pd, Fe, Ti, Cu, or magnesium.

The metallic, creep-resistant material may be non-magnetic. For example, the beam 104 may be formed of aluminum, platinum, silver, and/or Cu. Forming the beam 104 of a non-magnetic material may facilitate use of the switch structure 100 in environments in which the switch structure is expected to operate in the presence of strong magnetic fields, such as in magnetic resonance imaging applications.

Figure 6A:
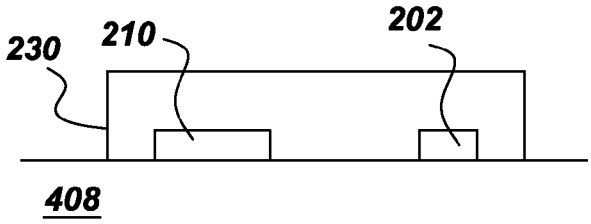
FIGS. 6A-E are schematic side views representing a process for fabricating a switch structure configured in accordance with an example embodiment.
Figure 6B:
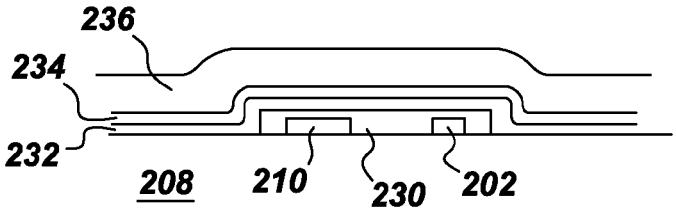
Figure 6C:
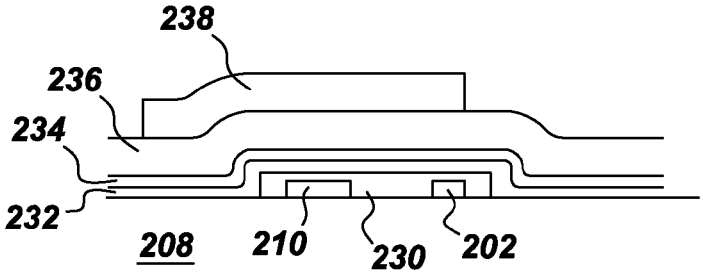
Figure 6D:
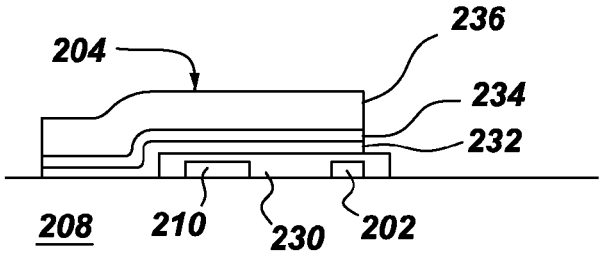
Figure 6E:
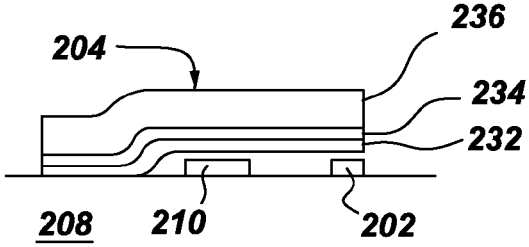

As mentioned above, switch structures as described above, such as the switch structure 100 of FIG. 1, can be fabricated on substrates using conventional microfabrication techniques. For example, referring to FIGS. 6A-E, therein is shown a schematic representation of a fabrication process for producing a switch structure configured in accordance with an example embodiment. First, a substrate 208 can be provided with an electrode 210 and a contact 202 disposed thereon. Silicon dioxide 230 can then be deposited, for example, by vapor deposition, and patterned so as to encapsulate the electrode 210 and contact 202 (FIG. 6A). A thin adhesion layer 232 (e.g., titanium), a seed layer 234 (e.g., gold), and a metal layer 236 (e.g., Ni-4 atomic percent W) can then be deposited via electroplating (FIG. 6B). Photoresist 238 could then be applied and patterned using conventional photolithography (FIG. 6C), after which the metal, seed, and adhesion layers 236, 234, 232 could be etched to form a beam 204 and the photoresist subsequently removed (FIG. 6D). Finally, the silicon dioxide 230 supporting the beam 204 and encapsulating the electrode 210 and contact 202 could be removed. Thereafter, the beam 204 may also be enclosed by a protective cap, for example, at a temperature of about 300-450° C.

While only certain features of the invention have been illustrated and described herein, many modifications and changes will occur to those skilled in the art. For example, while the conductive element of the switch structure 100 of FIG. 1 has been exemplified by a cantilevered beam, other deformable contact structures are also possible, including, for example, a fixed-fixed beam, a torsional element, and/or a diaphragm. Further, while the above description involved a beam having a monolithic metallic layer configured to inhibit time-dependent deformation, other embodiments may include a beam that is substantially formed of multiple layers of metallic material, with each (or most) of the layers being configured to inhibit time-dependent deformation. It is, therefore, to be understood that the appended claims are intended to cover all such modifications and changes as fall within the true spirit of the invention.

What is claimed:

1. A device comprising:

a contact; and a conductive element formed substantially of metallic material configured to inhibit time-dependent deformation, said conductive element being configured to be deformable between a first position in which said conductive element is separated from said contact and a second position in which said conductive element contacts said contact, wherein said metallic material is configured to exhibit a maximum steady-state plastic strain rate of less than $10^{-12}$ $s^{-1}$ when subject to a stress of at least about 25 percent of a yield strength of said metallic material and a temperature less than or equal to about half of a melting temperature of said metallic material.

2. The device of claim 1, wherein said conductive element establishes electrical communication with said contact when in the second position.

3. The device of claim 1, wherein said conductive element includes a structure selected from the group consisting of a cantilever, a fixed-fixed beam, a torsional element, and a diaphragm.

4. The device of claim 1, further comprising an electrode configured to be charged so as to apply an electrostatic force configured to urge said conductive element toward the second position.

5. The device of claim 1, wherein said contact and said conductive element are part of a microelectromechanical device or a nanoelectromechanical device.

6. The device of claim 1, wherein said conductive element has a surface area-to-volume ratio that is greater than or equal to about $10^3$ $m^{-1}$.

7. The device of claim 1, wherein said conductive element is configured to store therein sufficient energy during deformation to cause said conductive element to assume the first position in the absence of external forces.

8. The device of claim 1, wherein said metallic material includes amorphous metal.

9. The device of claim 1, wherein said metallic material has a melting temperature of at least 700° C.

10. The device of claim 1, wherein said metallic material is configured to inhibit time-dependent deformation at temperatures greater than 40° C.

11. The device of claim 1, wherein said metallic material is non-magnetic.

12. The device of claim 1, wherein said conductive element is configured to be separated from said contact by a separation distance that varies by less than about 40 percent when said conductive element substantially occupies the first position and to be urged toward the second position by an applied force and to substantially return to the first position in the absence of an applied force.

13. The device of claim 12, wherein said conductive element is configured to experience a stress of at least about 100 MPa over a cumulative time of at least about 10,000 seconds when occupying the second position.

14. The device of claim 1, further comprising a substrate, wherein each of said contact and said conductive element is disposed on said substrate.

15. The device of claim 14, wherein said substrate includes a metal oxide semiconductor field effect transistor.

16. The device of claim 1, wherein said metallic material includes an alloy of at least nickel and tungsten.

17. The device of claim 16, wherein said alloy of nickel and tungsten includes at least 65 atomic percent nickel and at least 1 atomic percent tungsten.

18. The device of claim 16, wherein said alloy of nickel and tungsten has an average grain size of less than or equal to about 1 μm.

19. The device of claim 1, further comprising a circuit having a first side and a second side at different electric potentials, wherein said contact and conductive element are respectively connected to one and the other of said first and second sides of said circuit, such that deformation of said conductive element between the first and second positions acts to respectively pass and interrupt a current therethrough.

20. The device of claim 19, wherein said first side includes a power source configured to supply a current with a magnitude of at least 1 mA and an oscillation frequency less than or equal to about 1 kHz.

21. The device of claim 19, further comprising a second conductive element formed substantially of metallic material configured to inhibit time-dependent deformation, said second conductive element being configured to be deformable between a first position in which said conductive element is separated from a second contact and a second position in which said conductive element contacts said second contact, wherein said conductive element and said second conductive element are arrayed in series and in parallel as part of a circuit disposed on a substrate.

22. The device of claim 19, wherein said conductive element is configured to be deformed between the first and second positions to respectively pass and interrupt a current therethrough at ambient temperatures under 30 percent of a melting temperature of said metallic material.

23. A device comprising:

a contact; and a conductive element formed substantially of an alloy of at least nickel and tungsten and configured to be deformable between a first position in which said conductive element is separated from said contact and a second position in which said conductive element contacts said contact, wherein said alloy of at least nickel and tungsten is configured to exhibit a maximum steady-state plastic strain rate of less than $10^{-12}$ $s^{-1}$ when subject to a stress of at least about 100 MPa and a temperature less than or equal to about half of the melting temperature of said alloy of at least nickel and tungsten.

24. The device of claim 23, wherein said conductive element establishes electrical communication with said contact when in the second position.

25. The device of claim 23, wherein said conductive element includes a structure selected from the group consisting of a cantilever, a fixed-fixed beam, a torsional element, and a diaphragm.

26. The device of claim 23, further comprising an electrode configured to be charged so as to apply an electrostatic force configured to urge said conductive element toward the second position.

27. The device of claim 23, wherein said contact and said conductive element are part of a microelectromechanical device or a nanoelectromechanical device.

28. The device of claim 23, wherein said conductive element has a surface area-to-volume ratio that is greater than or equal to $10^3$ $m^{-1}$.

29. The device of claim 23, wherein said conductive element is configured to store therein sufficient energy during deformation to cause said conductive element to assume the first position in the absence of external forces.

30. The device of claim 23, wherein said alloy of at least nickel and tungsten is configured to inhibit time-dependent deformation at temperatures greater than 40° C.

31. The device of claim 23, wherein said alloy of at least nickel and tungsten includes at least 65 atomic percent nickel and at least 1 atomic percent tungsten.

32. The device of claim 23, wherein said alloy of at least nickel and tungsten has an average grain size of less than or equal to about 1 μm.

33. The device of claim 23, wherein said conductive element is configured to be separated from said contact by a separation distance that varies by less than 40 percent when said conductive element occupies the first position and to be urged toward the second position by an applied force and to substantially return to the first position in the absence of an applied force.

34. The device of claim 33, wherein said conductive element is configured to experience a stress of at least about 100 MPa over a cumulative time of at least about 10,000 seconds when occupying the second position.

35. The device of claim 23, further comprising a substrate, wherein each of said contact and said conductive element is disposed on said substrate.

36. The device of claim 35, wherein said substrate includes a metal oxide semiconductor field effect transistor.

37. The device of claim 23, further comprising a circuit having a first side and a second side at different electric potentials, wherein said contact and conductive element are respectively connected to one and the other of said first and second sides of said circuit, such that deformation of said conductive element between the first and second positions acts to respectively pass and interrupt a current therethrough.

38. The device of claim 37, wherein said first side includes a power source configured to supply a current with an amplitude of at least 1 mA and an oscillation frequency less than or equal to about 1 kHz.

39. The device of claim 37, further comprising a second conductive element formed substantially of metallic material configured to inhibit time-dependent deformation, said second conductive element being configured to be deformable between a first position in which said conductive element is separated from a second contact and a second position in which said conductive element contacts said second contact, wherein said conductive element and said second conductive element are arrayed in series and in parallel as part of a circuit disposed on a substrate.

40. The device of claim 37, wherein said conductive element is configured to be deformed between the first and second positions to respectively pass and interrupt a current therethrough at ambient temperatures under 30 percent of a melting temperature of said alloy of at least nickel and tungsten.

* * * * *